US007621294B2

(12) United States Patent
Wang

(10) Patent No.: US 7,621,294 B2
(45) Date of Patent: Nov. 24, 2009

(54) MOUTHPIECE STRUCTURE OF WATER BAG

(76) Inventor: Lo-Pin Wang, 16F. -2, No. 62, Sec. 2, Chongde 2nd Rd., Beitun District, Taichung City 406 (TW)

( * ) Notice: Subject to any disclaimer, the term of this patent is extended or adjusted under 35 U.S.C. 154(b) by 658 days.

(21) Appl. No.: 11/490,314

(22) Filed: Jul. 21, 2006

(65) Prior Publication Data

US 2008/0000919 A1 Jan. 3, 2008

(51) Int. Cl.
*A47G 19/22* (2006.01)

(52) U.S. Cl. ..... 137/613; 222/175; 220/703

(58) Field of Classification Search ..... 137/613, 137/505.25; 222/175; 220/714, 703
See application file for complete search history.

(56) References Cited

U.S. PATENT DOCUMENTS 6,273,128 B1 * 8/2001 Paczonay ..... 137/512.3
6,622,988 B2 * 9/2003 Gill ..... 251/351
7,533,786 B2 * 5/2009 Woolfson et al. ..... 222/144.5
2003/0168470 A1 * 9/2003 Choi et al. ..... 222/14
2006/0113275 A1 * 6/2006 Huang et al. ..... 215/387

* cited by examiner

*Primary Examiner*—Kevin L Lee
(74) *Attorney, Agent, or Firm*—Browdy and Neimark, PLLC

(57) ABSTRACT

A mouthpiece of a water bag includes a flexible body with a tunnel therein, a closed end at an end of the flexible body, and an elongated crack on the closed end adapted to communicate the tunnel, whereby the crack is closed at a normal condition and is opened when the flexible body is compressed along an elongated direction of the crack, a cap detachably covering the closed end of the flexible body, which has a strip and a ring fitted to a slot on the flexible body. The cap may isolate dust from the close end of the flexible body that keeps the crack clean. The crack is closed in a normal condition, and the ring fitted to the flexible body may restrict the flexible body to ensure the crack closed.

19 Claims, 5 Drawing Sheets

MOUTHPIECE STRUCTURE OF WATER BAG

BACKGROUND OF THE INVENTION

1. Field of the Invention

The present invention relates generally a portable water bag, and more particularly to a mouthpiece structure of the water bag.

2. Description of the Related Art

Portable water bags are the common equipments of jogging, mountain-climbing, bicycle riding and so on. Typically, the conventional portable water bag includes a soft bag to be received in a backpack or in a specific pack. The bag has an intake to pour water into the bag, a lid to close the intake, a hose with an end connected to the bag, mouthpiece connected to a free end of the hose. People may suck the mouthpiece to drink water in the bag or just pour water on head or body to get cool. Such water bag has an opened mouthpiece that dust may be stuck on the mouthpiece and there is the leakage problem.

SUMMARY OF THE INVENTION

The primary objective of the present invention is to provide a mouthpiece structure of a water bag, which is cleaner for use.

The secondary objective of the present invention is to provide a mouthpiece structure of a water bag without leakage problem.

According to the objectives of the present invention, a mouthpiece of a water bag includes a flexible body with a tunnel therein, a closed end at an end of the flexible body, and an elongated crack on the closed end adapted to communicate the tunnel, whereby the crack is closed at a normal condition and is opened when the flexible body is compressed along an elongated direction of the crack, a cap detachably covering the closed end of the flexible body, which has a strip and a ring fitted to a slot on the flexible body. The cap may isolate dust from the close end of the flexible body that keeps the crack clean. The crack is closed in a normal condition, and the ring fitted to the flexible body may restrict the flexible body to ensure the crack closed.

BRIEF DESCRIPTION OF THE DRAWINGS

FIG. 4 is sectional view along 4-4 line of FIG. 3, showing the switch on;

DETAILED DESCRIPTION OF THE INVENTION

Figure 1:
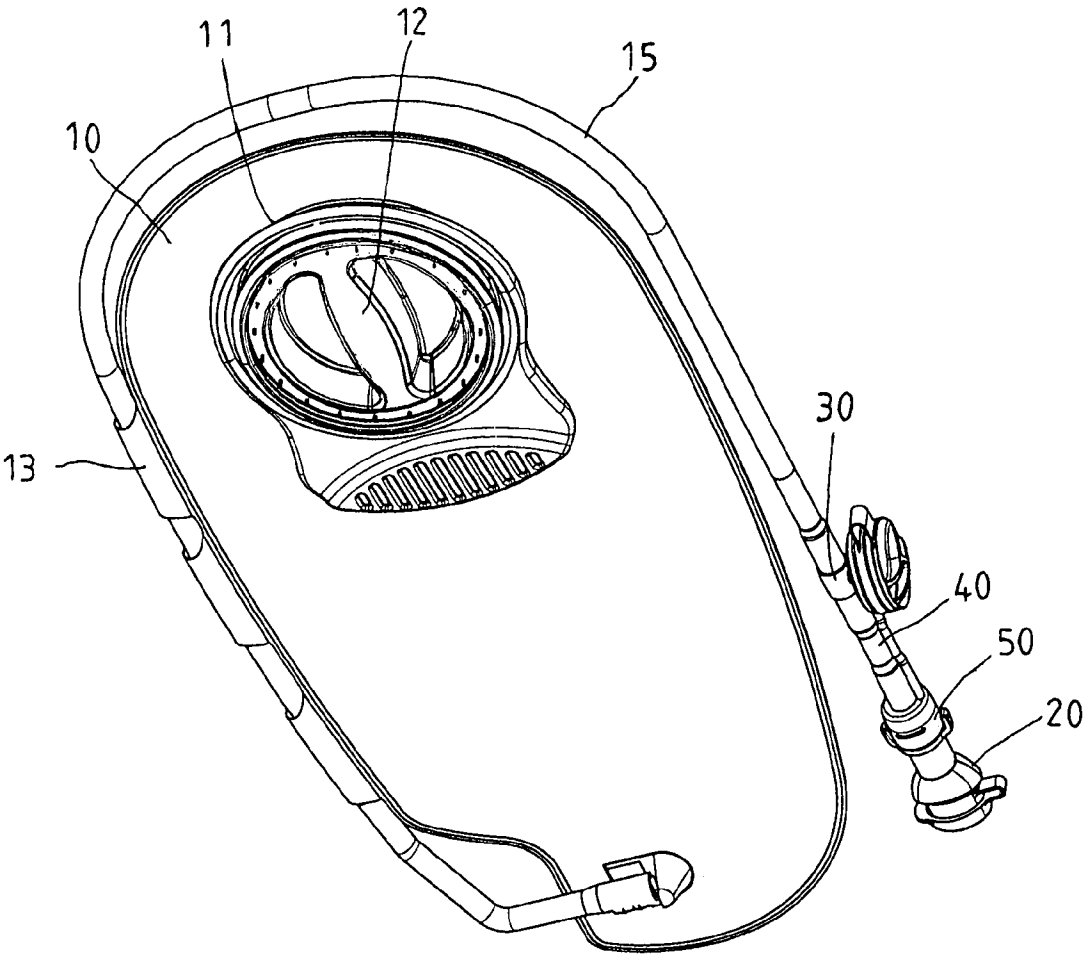
FIG. 1 is a perspective view of a preferred embodiment of the present invention.
Figure 2:
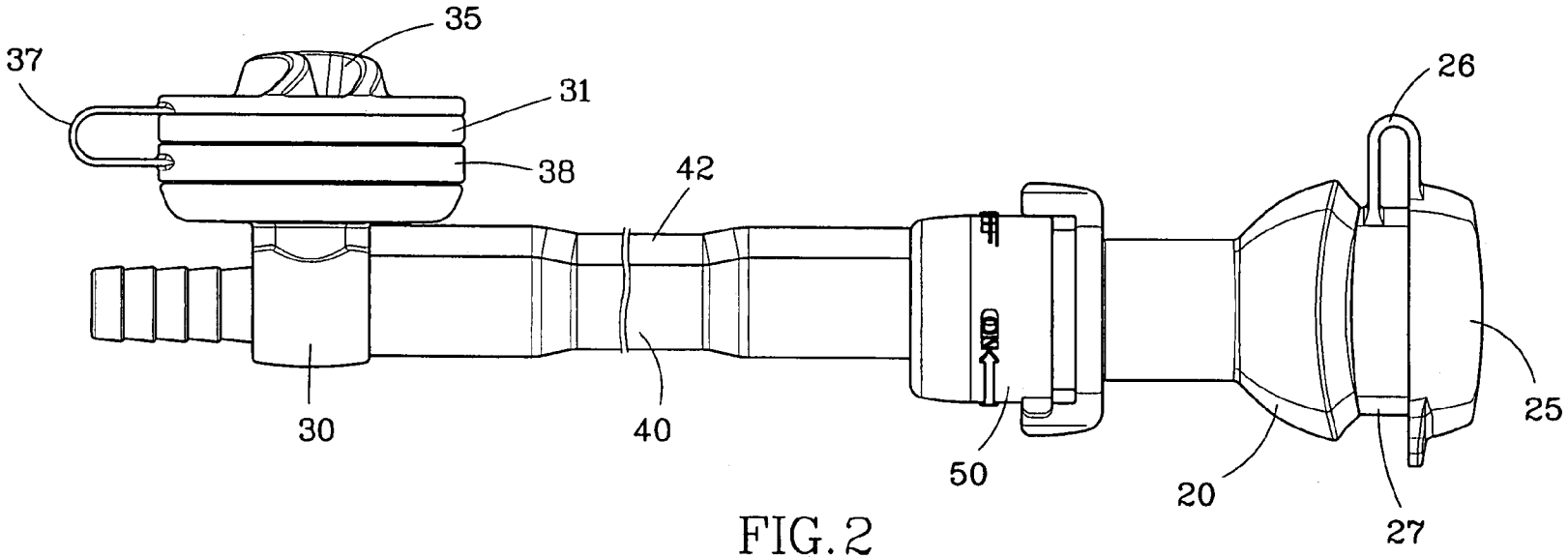
FIG. 2 is a front view of the preferred embodiment of the present invention.
Figure 3:
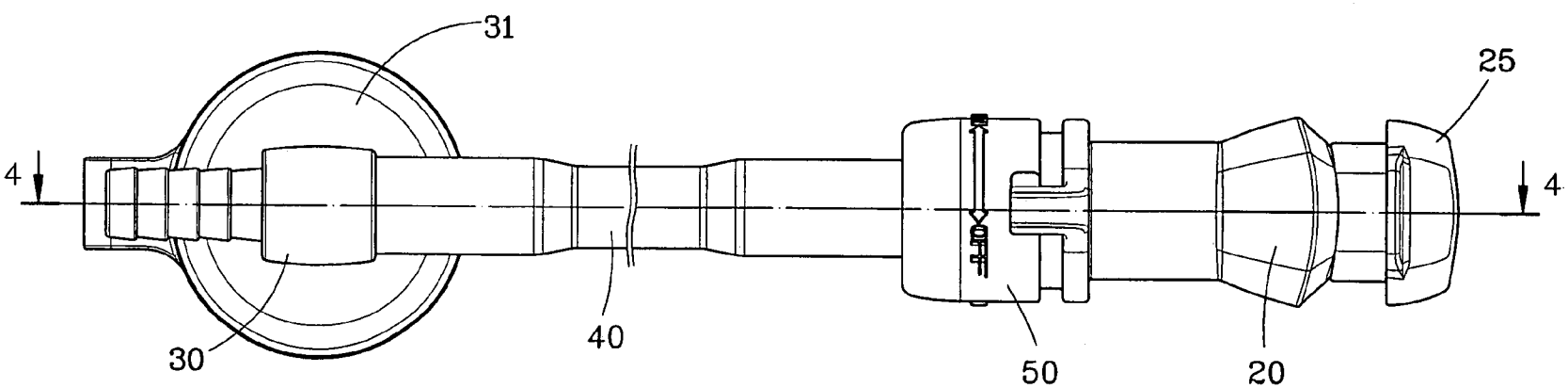
FIG. 3 is a bottom view of the preferred embodiment of the present invention.

As shown in FIG. 1, a water bag of the preferred embodiment of the present invention includes:

A soft bag 10 has an intake 11 to inject water.

A lid 12 covers the intake 11 to close or open the intake 11.

A hose 15 has an end connected to the bag 10. The bag 10 has three rings 13 on a side for the hose 15 passing through.

A mouthpiece 20 is connected to a free end of the hose 15.

Figures 7, 8:
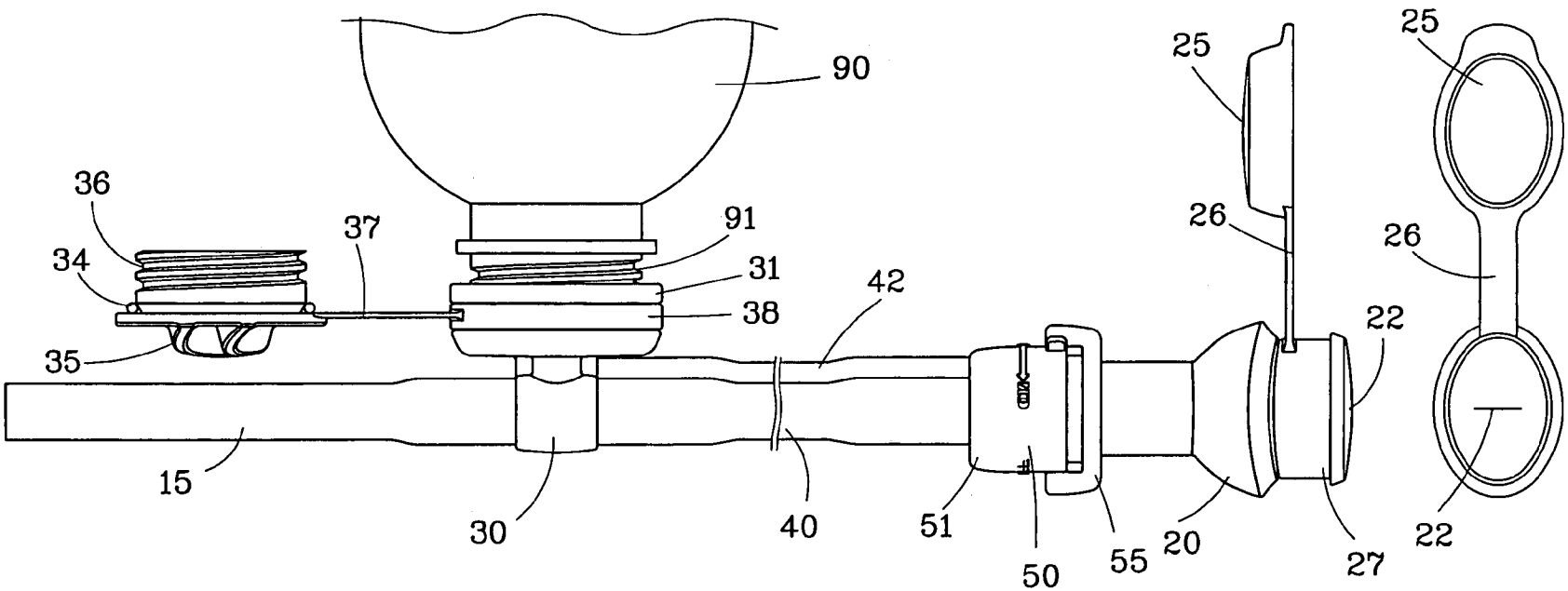
FIG. 7 is a sketch diagram, showing the present invention in operation.
FIG. 8 is a right view of FIG. 7, showing the aspect of the opening.

As shown in FIG. 2 to FIG. 8, the mouthpiece 20 includes a flexible body, a tunnel 21 in the flexible body and a closed end on an end. On the closed end of the tunnel 21, an elongated crack 22 is provided, as shown in FIG. 8. The crack 22 is closed in a normal condition, such that water will not flow out, and it is opened when the flexible body is compressed along an elongated direction of the crack 22, such that water may flow out. A cap 25 covers the closed end of the mouthpiece 20 with a strip 26 and a ring 27. The ring 27 is fitted to a slot 23 on a circumference of the mouthpiece 20, such that the cap 25 will not loose. The main purpose of the cap 25 is dustproof, except that the cap 25 compresses the mouthpiece 20 to seal the crack 22 for leakage-proof when the cap 25 is mountedon the mouthpiece 20. The ring 27 may restrict the flexible body to ensure the crack 22 closed.

Figure 4:
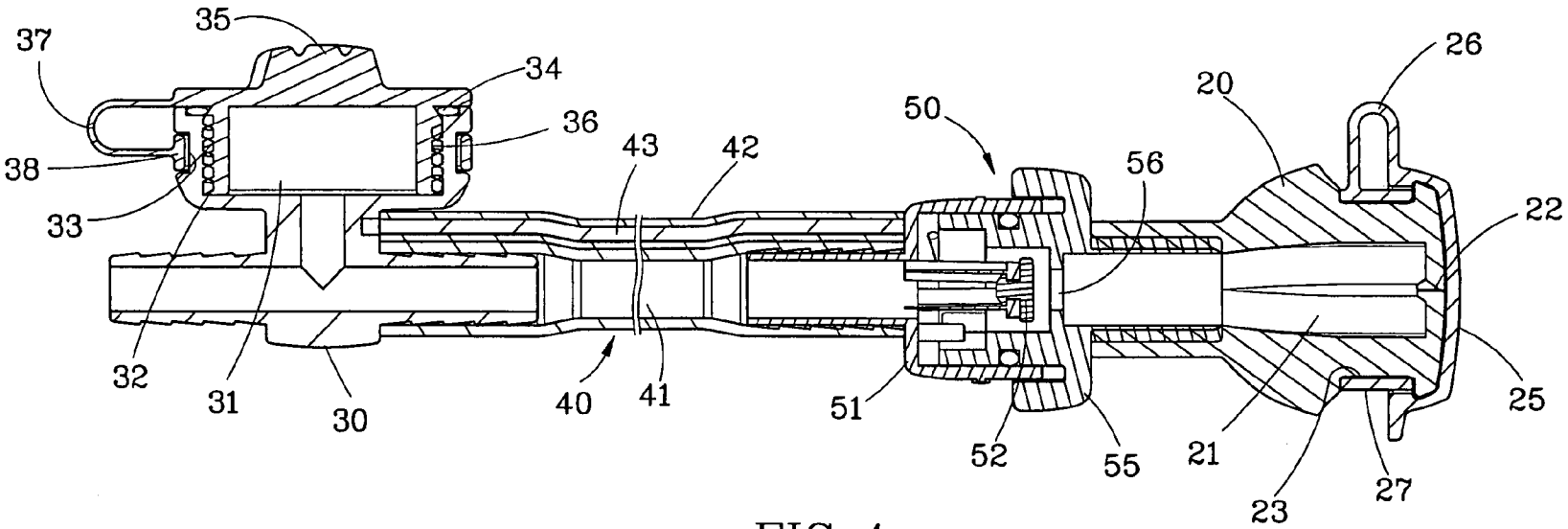
Figure 5:
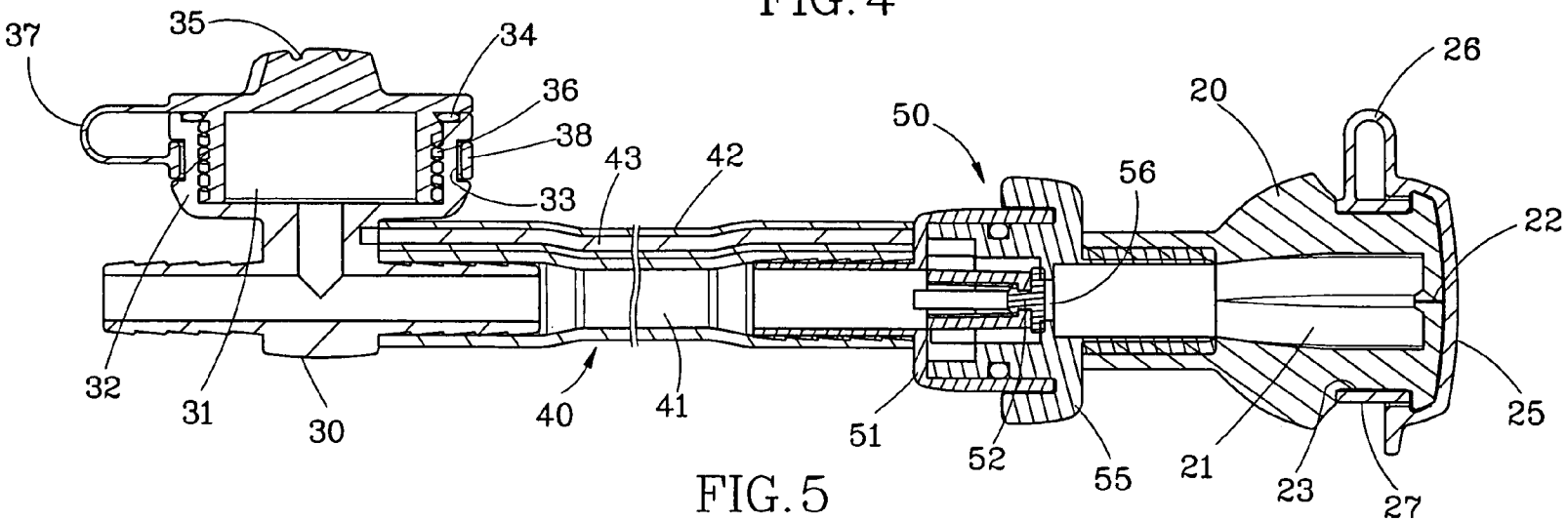
FIG. 5 is similar to FIG. 4, showing the switch off.
Figure 6:
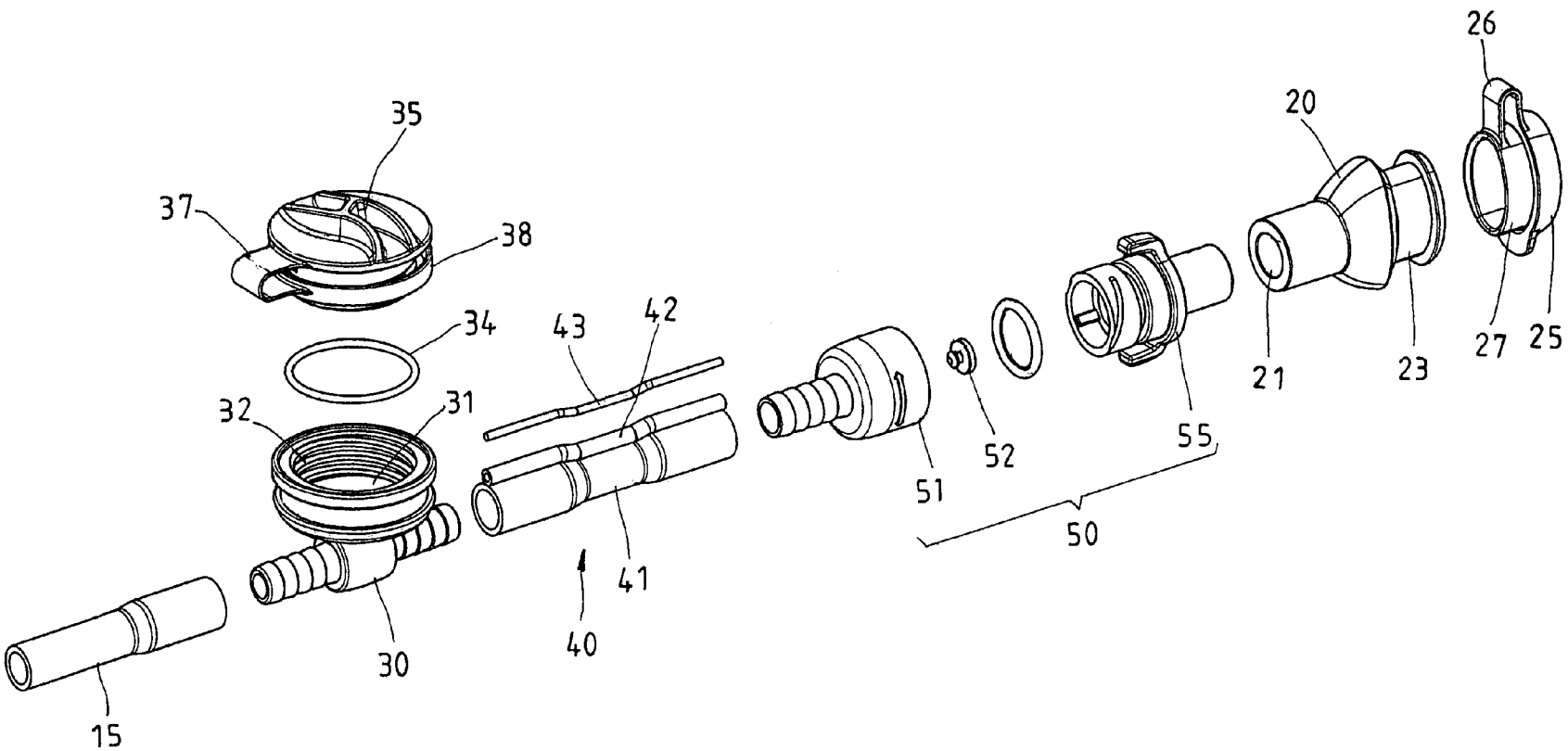
FIG. 6 is an exploded view of the preferred embodiment of the present invention.

The water bag of the present invention is further provided with a switch 50 connected to the mouthpiece 20. The switch 50 includes two members 51, 55, in which the first member 51 is connected to the hose 15 directly or indirectly and the second member 55 is connected to the mouthpiece 20. The members 51, 55 are connected together and may be rotated relative to each other. The second member 55 as a tunnel 56, and the first member 51 has a plug 52. When the members 51, 55 are turned, the first member 51 may be moved away from the second member 55, as shown in FIG. 4, in which water may flow through the switch 50. The members 51, 55 also may be turned in opposite direction to have the first member 51 moved toward the second member 55, as shown in FIG. 5, in which the plug 52 seals the tunnel 56 to cut off water.

With the switch 50, there will be no leakage problem in the water bag of the present invention.

In addition, for convenience of operation, a plastic deformation tube 40, which may be bent and fixed in a predetermined shape, is mounted between the three-way valve 30 and the mouthpiece 20. The plastic deformation tube 40 includes a main tube 41, a sub-tube 42 attached on a circumference of the main tube 41, and a metal bar 43 in the sub-tube 42. The metal bar 43 may be bent and fixed at that shape. With the plastic deformation tube 40, user may adjust the mouthpiece 20 at desired positions, such that user may drink water without having to hold the mouthpiece 20.

Furthermore, for convenience of water refilling, a three-way valve 30 is provided a first end connected to the hose 15, a second end connected to the plastic deformation tube 40 and a third end forming a water inlet 31. On an interior wall of the water inlet 31 of the connector three-way 30, a threaded section 32 is provided. The water inlet 31 may be engaged with a common mineral water bottle, as shown in FIG. 7. A cap 35 has a threaded section 36 to be screwed to a threaded section 32 of the water inlet 31. The cap 35 is provided with a strip 37 and a ring 38 on an end of the strip 37. The ring 38 is fitted to an annular slot 33 on the three-way valve 30 adjacent to the water inlet 31, such that the cover will not loose when the cap 35 is opened. A leakage-proof ring 34 is provided in the cap 35 to press the three-way valve 30 when the cap 35 is screwed onto the three-way valve 30 for leakage-proof.

When water in the bag 10 is out, user may open the cap 35 and screw an opening 91 of a common water bottle 90 into the water inlet 31, as shown in FIG. 7, to inject water into the bag 10 through the hose 15. After filling, user only needs to close the cap 35 that is a very convenient operation.

The description above is a few preferred embodiments of the present invention and the equivalence of the present invention is still in the scope of the claim of the present invention.

What is claimed is:

1. A mouthpiece of a water bag, comprising a flexible body with a tunnel therein, a closed end at an end of the flexible body, and an elongated crack on the closed end adapted to communicate the tunnel, whereby the crack is closed at a normal condition and is opened when the flexible body is compressed along an elongated direction of the crack, a cap detachably covering the closed end of the flexible body, which has a strip and a ring fitted to a slot on the flexible body.

2. The mouthpiece as defined in claim 1, further comprising a switch connected to an end of the flexible body opposite to the closed end.

3. The mouthpiece as defined in claim 2, wherein the switch includes two members connected together and rotated relative to each other, one of which has a tunnel and the other of which has a plug, such that the plug may be moved toward the tunnel and seal the tunnel when the members are turned to a direction, and the plug may be moved away from the tunnel when the members are turned to an opposite direction.

4. The mouthpiece as defined in claim 1, further comprising a plastic deformation tube to an end of the flexible body opposite to the closed end.

5. The mouthpiece as defined in claim 4, wherein the plastic deformation tube includes a main tube and a metal bar fixed to the main tube, such that the main tube may be bent and fixed at any shape.

6. The mouthpiece as defined in claim 5, wherein the main tube has a sub-tube, in which the metal bar is received.

7. The mouthpiece as defined in claim 2, further comprising a plastic deformation tube to an end of the switch.

8. The mouthpiece as defined in claim 1, further comprising a three-way valve, which has an end connected to the mouthpiece and an end forming a water inlet, and a cap detachably covering the water inlet.

9. The mouthpiece as defined in claim 8, wherein the three-way valve has a threaded section on an interior side of the water inlet to be engaged with a water bottle.

10. The mouthpiece as defined in claim 9, wherein the cap has a threaded section to be engaged with the threaded section of the three-way valve.

11. The mouthpiece as defined in claim 10, further comprising a leakage-proof ring between the cap and the water inlet of the three-way valve.

12. The mouthpiece as defined in claim 11, wherein the leakage-proof ring is provided on the cap next to the threaded section.

13. The mouthpiece as defined in claim 8, wherein on an exterior side of the water inlet, a slot is provided, and the cap has a strip and a ring on a free end of the strip to be fitted to the slot.

14. The mouthpiece as defined in claim 7, further comprising a three-way valve, which has an end connected to the plastic deformation tube and an end forming a water inlet, and a cap detachably covering the water inlet.

15. The mouthpiece as defined in claim 14, wherein the three-way valve has a threaded section on an interior side of the water inlet to be engaged with a water bottle.

16. The mouthpiece as defined in claim 15, wherein the cap has a threaded section to be engaged with the threaded section of the three-way valve.

17. The mouthpiece as defined in claim 16, further comprising a leakage-proof ring between the cap and the water inlet of the three-way valve.

18. The mouthpiece as defined in claim 17, wherein the leakage-proof ring is provided on the cap next to the threaded section.

19. The mouthpiece as defined in claim 14, wherein on an exterior side of the water inlet, a slot is provided, and the cap has a strip and a ring on a free end of the strip to be fitted to the slot.

* * * * *